US007464634B1

(12) United States Patent
Shah et al.

(10) Patent No.: US 7,464,634 B1
(45) Date of Patent: Dec. 16, 2008

(54) COLD LAUNCH SYSTEM COMPRISING SHAPE-MEMORY ALLOY ACTUATOR

(75) Inventors: Tushar K. Shah, Columbia, MD (US); Grant W. Corboy, Baltimore, MD (US); William Russell Kraft, II, Forest Hill, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 286 days.

(21) Appl. No.: 11/379,682

(22) Filed: Apr. 21, 2006

(51) Int. Cl.
*F41F 1/00* (2006.01)
*F41F 3/00* (2006.01)
*F41F 5/00* (2006.01)

(52) U.S. Cl. ..... 89/1.8; 89/1.1

(58) Field of Classification Search ..... 89/1.8, 89/1.816, 1.819, 28.05, 28.1, 1.1; 102/293; 148/402
See application file for complete search history.

(56) References Cited

U.S. PATENT DOCUMENTS 3,745,877 A * 7/1973 Dobson et al. ..... 89/28.05
4,036,140 A * 7/1977 Korr et al. ..... 102/438
4,036,141 A * 7/1977 Korr et al. ..... 102/438
4,492,143 A * 1/1985 Ruhle ..... 89/1.816
4,493,664 A * 1/1985 Dale ..... 441/7
4,524,343 A * 6/1985 Morgan et al. ..... 337/140
4,759,293 A * 7/1988 Davis, Jr. ..... 102/520
4,791,870 A * 12/1988 Simpson ..... 102/342
4,926,740 A * 5/1990 Griffin et al. ..... 89/1.819
5,046,426 A * 9/1991 Julien et al. ..... 102/377
5,060,470 A * 10/1991 VanName ..... 60/253
5,119,555 A * 6/1992 Johnson ..... 29/254
5,159,145 A * 10/1992 Carisella et al. ..... 89/1.15
5,245,738 A * 9/1993 Johnson ..... 29/413
5,312,152 A * 5/1994 Woebkenberg et al. ..... 294/86.4
5,322,002 A * 6/1994 Miskelly et al. ..... 89/8
5,408,932 A * 4/1995 Hesse et al. ..... 102/501
5,448,941 A * 9/1995 Godfrey et al. ..... 89/1.809
5,619,177 A * 4/1997 Johnson et al. ..... 337/140
5,771,742 A * 6/1998 Bokaie et al. ..... 74/2
5,829,253 A * 11/1998 Long et al. ..... 60/528
6,019,025 A * 2/2000 St. Amand ..... 89/1.817
6,208,044 B1 * 3/2001 Viswanadham et al. ..... 310/12
6,354,182 B1 * 3/2002 Milanovich ..... 89/1.818
6,508,437 B1 * 1/2003 Davis et al. ..... 244/173.2
6,631,667 B1 * 10/2003 Chisholm ..... 89/1.14
6,688,233 B1 * 2/2004 Manole et al. ..... 102/437
6,843,014 B1 * 1/2005 Aponte et al. ..... 42/70.06
7,117,673 B2 * 10/2006 Szilagyi ..... 60/528
7,270,060 B1 * 9/2007 Manole et al. ..... 102/521
7,287,485 B2 * 10/2007 Petrakis ..... 116/216
2006/0011055 A1 * 1/2006 Root, Jr. ..... 89/1.819
2006/0107828 A1 * 5/2006 Veitch et al. ..... 89/1.809

* cited by examiner

*Primary Examiner*—Bret Hayes
(74) *Attorney, Agent, or Firm*—DeMont & Breyer LLC

(57) ABSTRACT

A cold-launch uses shape-memory-alloy ("SMA") actuators to accelerate materiel to a required launch velocity. The SMA actuators are arranged into one or more actuation stages. SMA actuators within a given actuation stage are simultaneously triggered. Actuation stages, however, are triggered sequentially, each triggering adding to the velocity of the materiel.

20 Claims, 5 Drawing Sheets

COLD LAUNCH SYSTEM COMPRISING SHAPE-MEMORY ALLOY ACTUATOR

FIELD OF THE INVENTION

The present invention relates generally to launch systems, and more particularly to cold launch systems.

BACKGROUND OF THE INVENTION

A canisterized missile is typically launched using the missile's launch booster—so called "hot launch." When the booster fires, a plume of very high-temperature, high-velocity exhaust gas is generated. The plume, which in some cases contains metallic particulates, is very erosive. Direct exposure to the plume would have an adverse effect on the missile, the missile canister, other launch structures, and the surrounding environs (e.g., deck of a ship, etc.).

As a consequence, most missile-launch systems include an exhaust-gas management system, which directs the booster plume away from the missile and launch structure. To withstand the plume's extreme conditions, the launch structure, as well as the exhaust-gas management system itself, must incorporate thermal-protection and erosion-protection materials.

Incorporation of the exhaust-gas management system and the protective materials necessarily enlarges the missile-launch system as well as increasing its weight, cost and complexity. Furthermore, the heating of the launch structure and deck that results from hot launch creates a residual thermal signature. This signature is readily detectable by various sensors, and therefore potentially compromises the survivability of the missile launcher and, indeed, the ship or vehicle that supports it. Also, by its nature, hot launch technology increases the volatility of a missile due to the presence of the additional energetics, which are stored in the missile's booster.

To address the problems of hot launch, "cold-launch" systems have been developed. A booster is not used to eject the missile from the missile canister during cold launch. Rather, some other means that does not generate the high temperatures or the erosive flow of a missile plume is used. For example, cold launch systems that use air bag inflators and electromagnetics to launch missiles are under development or are currently in use.

The absence of the launch booster eliminates the risk, formerly borne, associated with storing potentially harmful energetics on the launch platform. In addition, since an exhaust-gas management system is not required for cold launch, the launch system is necessarily smaller and requires far less deck space. Furthermore, the deck heating/thermal signature problem is substantially reduced or eliminated since, during cold launch, the missile's primary booster fires only after the missile clears the canister is and well away from the deck.

But existing cold launch systems are not without drawbacks of their own. One drawback is that most cold launch system include a substantial number of additional components, which raises reliability issues. Another drawback is that in some cold launch systems, the missile is exposed to high-pressure gas from a gas generator (that provides the pressure for launch). Also, electromagnetic launch systems require a great deal of electrical current to launch a missile.

What is needed, therefore, is a new type of cold-launch system that avoids the drawbacks of existing cold-launch technologies.

SUMMARY OF THE INVENTION

The present invention provides for cold launch without some of the costs and shortcomings of the prior art.

The illustrative embodiment of the present invention is a materiel launcher comprising a cold-launch system. Unlike known systems, the subject cold-launch system uses shape-memory-alloy ("SMA") actuators to accelerate the munition to the required velocity.

As the name implies, shape-memory-alloy actuators incorporate shape-memory alloys. These alloys have the ability to return to a predetermined shape when heated, such as by electrical current. This memory effect is due to their temperature-dependent crystallographic nature. One commonly used shape-memory alloy is "Nitinol," which is an alloy of nickel and titanium.

A typical implementation of an SMA actuator has a preloaded spring (i.e., a compressed spring) that is maintained in compression via a ball-detent mechanism. A shape-memory alloy is positioned so that, upon heating and returning to its original shape, it engages the ball-detent mechanism, releasing the balls from a locking position. Movement of the balls releases the spring. As the spring releases, it forcibly drives a rod, etc., outward from an output end of the actuator. Movement of the rod, which can be very rapid (full extension within milliseconds), can be harnessed to do useful work. In the context of the present invention, the work performed is to accelerate a load, such as a munition, to a launch velocity.

Historically, SMA ejectors have been used in outer space to release (e.g., unlock, etc) deployables, such as solar panels, etc., in zero gravity. They have, not, however, been used as the basis for a terrestrial, cold-launch system. SMA ejectors/actuators are available from TiNi Aerospace, Inc., of San Leandro Calif. (see, www.tiniaerospace.com).

At a minimum, a materiel launcher having a cold-launch system in accordance with the illustrative embodiment of the present invention will incorporate a first stage of SMA actuators. This first stage includes a first group of SMA actuators that are disposed on a fixed platform at the base of the launcher. A second platform typically overlies the first group of SMA actuators. In the case of a single-stage system, the load (e.g., munition, etc.) is disposed directly on this second platform. In operation, all SMA actuators within the first stage trigger simultaneously, providing a movement-generating impulse to the overlying platform and load.

In some embodiments, the cold-launch system disclosed herein will incorporate one or more additional stages of actuators. In such a multi-stage system, SMA actuators will be organized into multiple groups that reside on separate, sequentially-arranged, individually-movable platforms. The stages are individually triggerable and, in fact, are triggered one after the other, with each triggering adding to the velocity of the load. Sequenced triggering can provide a relatively high launch velocity while remaining within g-force limitations of the load.

Thus, in a multi-stage cold-launch system, SMA actuators in first stage (i.e., those at the base of the launcher) are simultaneously triggered to begin the launch. Upon triggering, rods, etc., rapidly extend under spring bias from the output end of the SMA actuators. The rods impart an impulse to the overlying platform, which urges it and everything above it (e.g., a second stage of SMA actuators, an overlying platform, and the load) into motion.

Some time after the first stage SMA actuators are triggered, the second stage SMA actuators trigger. The time at which the second stage triggers can be based on sensor readings of the position or velocity of an overlying platform, etc., or can be a specific elapsed time, etc.

In any case, as the second stage SMA actuators trigger, they impart additional force to the load, etc., thereby increasing its velocity. To the extent further groups of SMA actuators are present, they likewise sequentially trigger, increasing the velocity of the load to the required launch velocity.

It will be appreciated that as the second stage SMA actuators trigger, the platform on which they are disposed must be secured. If the platform is not secured, a velocity-increasing impulse will not be imparted to the overlying platform and load. In fact, in such a case, since the overlying platform and load are heavier than the triggering SMA actuators and their supporting platform, that supporting platform will simply decelerate or be forced downward (opposite to the direction of launch).

As a consequence, all platforms that are disposed above the first stage of SMA actuators that support SMA actuators are "one-way" platforms. This means that the platforms can only move in the direction of launch (e.g., upward, outward, etc.). If actuators on any of such platforms trigger, the platform will lock in position in response to the impulse. This can be accomplished, for example, using "bar-clamp-" type mechanisms (e.g., sliding jaw with clutch, etc.).

As such, when the second group of SMA actuators trigger, the supporting platform locks in place so that the force that is released imparts motion to the overlying platform(s), etc.

In one embodiment, the present invention provides an apparatus comprising a cold-launch system, wherein the cold-launch system comprises:

a first stage comprising a first plurality of shape-memory-alloy actuators arranged in a first layer; and a second stage comprising a second plurality of shape-memory-alloy actuators arranged in a second layer, wherein:

(a) each actuator in both the first stage and the second stage has an output end that is operatively coupled to a load;

(b) the output end of each of the actuators in the first stage are co-planar;

(c) the output end of each of the actuators in the second stage are co-planar;

(d) the first and second stages are sequentially disposed; and (e) the second stage is proximal to the load.

In another embodiment, the present invention provides a method for launch comprising:

(a) providing a first plurality of shape-memory-alloy actuators arranged in a first layer, wherein said first plurality of actuators are operatively coupled to a load; and (b) triggering said first plurality actuators simultaneously at a first time.

DETAILED DESCRIPTION

The following terms are defined for use in this Specification, including the appended claims:

Physically-coupled means direct, physical contact between two objects (e.g., two surfaces that abut one another, etc.).

Mechanically-coupled means that two or more objects interact with one another such that movement of one of the objects affects the other object.

For example, consider an actuator and a platform. When triggered, the actuator causes the platform to move. The actuator and the platform are therefore considered to be "mechanically-coupled." Mechanically-coupled devices can be, but are not necessarily, physically coupled. In particular, two devices that interact with each other through an intermediate medium are considered to be mechanically coupled. Continuing with the example of the platform and the actuator, if the platform supports a load such that the load moves when the platform moves (due to the actuator), then the actuator and the load are considered to be mechanically coupled as well.

Electrically-coupled means that two objects are in electrical contact. This can be via direct physical contact (e.g., a plug in an electrical outlet, etc.), via an electrically-conductive intermediate (e.g., a wire that connects devices, etc.), or via intermediate devices, etc. (e.g., a resistor electrically connected between two other electrical devices, etc.).

Operatively-coupled means that the operation of one object affects another object. For example, consider an actuator that is actuated by electrical current, wherein the current is provided by a current source. The current source and the actuator are considered to be "operatively-coupled" (as well as "electrically coupled"). Operatively-coupled devices can be coupled through any medium (e.g., semiconductor, air, vacuum, water, copper, optical fiber, etc.) and involve any type of force. Consequently, operatively-coupled objects can be electrically-coupled, hydraulically-coupled, magnetically-coupled, mechanically-coupled, optically-coupled, pneumatically-coupled, thermally-coupled, etc.

Figure 1:
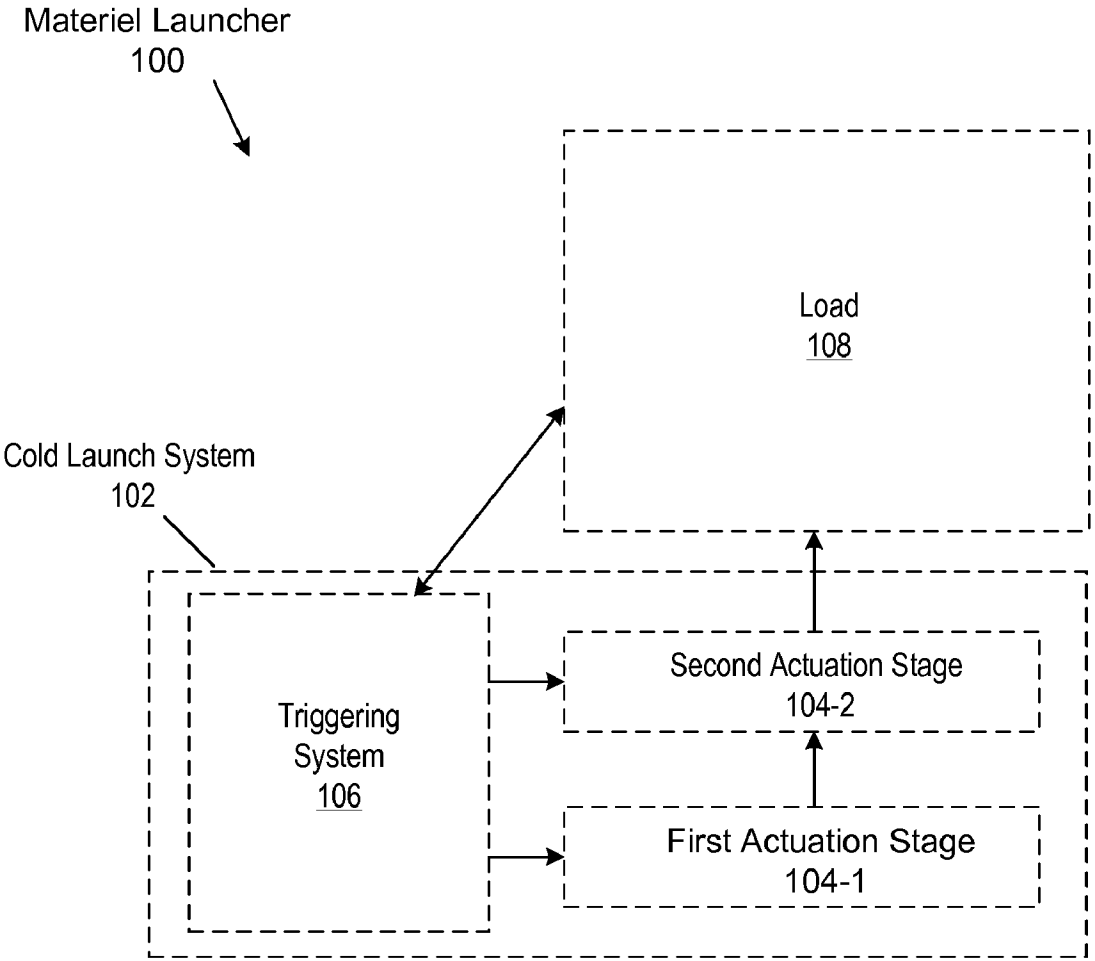
FIG. 1 depicts a launcher with a cold launch system in accordance with the illustrative embodiment of the present invention.

FIG. 1 depicts the salient features of launcher 100, which incorporates a cold launch system in accordance with the illustrative embodiment of the present invention. Launcher 100 comprises cold launch system 102 and load 108.

Load 108 is typically, but not necessarily, a munition, such as a missile, torpedo, and the like. More generally, load 108 is any of a variety of different types of materiel. For example, in some other embodiments, load 108 is an unmanned aerial vehicle, a sonobuoy, a countermeasure, etc.

Cold-launch system 102 launches load 108. In the illustrative embodiment, cold launch system 102 includes first actuation stage 104-1, optional second actuation stage 104-2, and triggering system 106, interrelated as shown. As described further below, actuation stages **104-*i*, i=1, j (e.g., 104-1, 104-2**, etc.) incorporate SMA actuators.

The one or more actuation stages **104-*i*, which are operatively coupled to load 108, provide an impulse to load 108 that accelerates it to launch velocity. Triggering system 106** sequentially activates each actuation stage.

In operation, triggering system 106 triggers first actuation stage 104-1. Triggering of the first stage imparts motion to load 108, as well anything that is between the first stage and the load. For example, in embodiments in which second actuation stage 104-2 is present, it is accelerated into motion as well.

Second actuation stage 104-2, if present, is triggered some time after the first stage. More generally, to the extent multiple actuation stages **104-*i*, i=1, j are present, they are sequentially triggered. Triggering the second stage imparts additional velocity to load 108. In some embodiments, the triggering of actuation stages 2 through j is based on velocity or position readings obtained from sensors. The sensors can be disposed within load 108 or on the launcher superstructure. Further details concerning triggering system 106** are provided later in this specification.

Figure 2C:
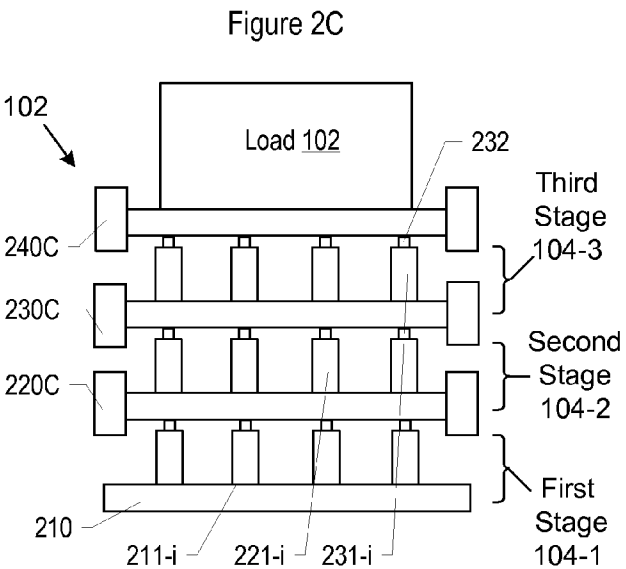
FIG. 2C depicts the salient features of a three-stage cold launch system in accordance with the illustrative embodiment of the present invention.
Figure 2A:
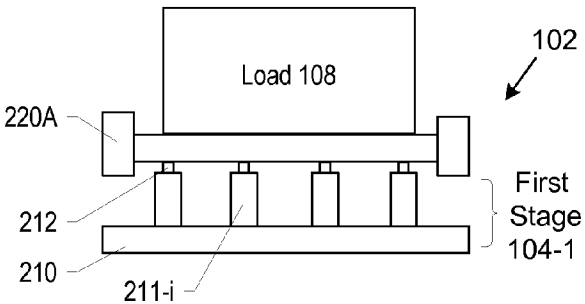
FIG. 2A depicts the salient features of a one-stage cold launch system in accordance with the illustrative embodiment of the present invention.
Figure 2B:
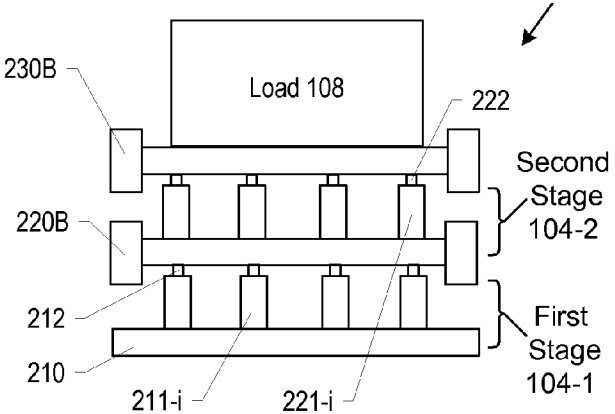
FIG. 2B depicts the salient features of a two-stage cold launch system in accordance with the illustrative embodiment of the present invention.

Further details concerning the salient elements of cold launch system 102 are now provided in conjunction with a discussion of FIGS. 2A-2C.

FIGS. 2A through 2C depict several embodiments of cold-launch system 102, focusing particularly on the elements of each actuation stage **104-*i*, i=1, j and their interrelationships. For clarity, triggering system 106** is not depicted in these Figures.

FIG. 2A depicts an embodiment of cold-launch system 102 that incorporates a single actuation stage—first actuation stage 104-1. First actuation stage 104-1 includes fixed platform 210 and a first plurality of SMA actuators $\mathbf{211}_i$, wherein i=1, k.

SMA actuators $\mathbf{211}_i$ are disposed on fixed platform 210. SMA actuators $\mathbf{211}_i$ are arranged so that:

(1) output end 212 of each SMA actuator $\mathbf{211}_i$ is co-planar with respect to all other SMA actuators within first actuation stage 104-1; and (2) when triggered by triggering system 106, all SMA actuators $\mathbf{211}_i$, i=1, k within first actuation stage 104-1 trigger simultaneously.

The precise number, k, of SMA actuators that are used in first actuation stage 104-1 is dependent upon the weight of overlying platform 220A, the weight of load 108, the velocity to which the load (and platform 220A) must be accelerated, and the capacity of SMA actuators $\mathbf{211}_i$.

Platform 220A is disposed on output end 212 of each SMA actuator $\mathbf{211}_i$ in first actuation stage 104-1. Load 108 resides on platform 220A. Platform 220A is movable, of course, to enable it and load 108 to be accelerated to launch velocity. In some embodiments, platform 220A couples to rails or like guides, thereby limiting movement of the platform to a guide-dictated direction (e.g., vertical, etc.).

In some further embodiments, platform 220A is a "one-way" platform. This means that the platform can only move "forward;" that is, in the direction of launch. For reasons that will become apparent in conjunction with the discussion of FIG. 2B, the use of a one-way platform is not required when only a single actuation stage is present. Nevertheless, it is desirable to use a one-way platform in such embodiments to prevent platform 220A from slamming down onto SMA actuators $\mathbf{211}_i$ after load 108 has been launched. As described further in conjunction with FIGS. 2B and 2C, the use of a one-way platform is required, however, in other embodiments that use two or more actuation stages such that an additional group of SMA actuators are disposed on the platform.

Implicit in the use of a single actuation stage, as in the embodiment depicted in FIG. 2A, is that a single impulse must impart all velocity that is required to launch load 108. Of course, to the extent that launch velocity is imparted to load 108 via a single impulse, the acceleration it experiences is maximized. Certain loads 108, such as some missiles in particular, have limits pertaining to the maximum amount of g-force that they can tolerate. In fact, in some situations, accelerating load 108 via single impulse will exceed g-force constraints. As a consequence, in some embodiments, such as those depicted in FIGS. 2B and 2C, cold-launch system 102 incorporates two or more actuation stages to limit the amount of acceleration that is experienced by load 108.

FIG. 2B depicts an embodiment of cold-launch system 102 that incorporates two actuation stages 104-1 and 104-2. First actuation stage 104-1 includes first plurality of SMA actuators $\mathbf{211}_i$, wherein i=1, l, and fixed platform 210. Second actuation stage 104-2 includes a second plurality of SMA actuators $\mathbf{221}_i$, wherein i=1, m, and one-way platform 220B.

Second actuation stage 104-2 "overlies" first actuation stage 104-1. More particularly, platform 220B abuts output end 212 of each SMA actuator $\mathbf{211}_i$ in first actuation stage 104-1. Since in this embodiment, SMA actuators $\mathbf{221}_i$ reside on platform 220B, it must be a one-way platform. As previously indicated, this is required so that the impulse delivered by SMA actuators $\mathbf{221}_i$ imparts motion to the overlying platform (i.e., platform 230B), rather than simply decelerating platform 220B. This "one-way" characteristic can be provided using, for example, a bar-clamp type arrangement with a sliding jaw and clutch that couple platform 230B to vertically-oriented rails or guides.

Like the embodiment that is depicted in FIG. 2A, the total number, l+m, of SMA actuators that are used in the embodiment that is depicted in FIG. 2B is dependent upon the weight of platforms 220B and 230B, the weight of load 108, the velocity to which load 108 (and platforms) must be accelerated, and the capacity of the SMA actuators.

Neither the number nor the capacity of SMA actuators $\mathbf{211}_i$ in first actuation stage 104-1 is necessarily equal to the number or capacity of SMA actuators $\mathbf{221}_i$ in second actuation stage 104-2. Likewise, neither the number nor capacity of SMA actuators in the first actuation stage of the embodiment that is depicted in FIG. 2A is necessarily equal to the number or capacity of the SMA actuators in the first actuation stage of the embodiment that is depicted in FIG. 2B.

There is currently no particular preference as to the manner in which the SMA actuators are apportioned between multiple stages. Typically, and to the extent possible, SMA actuators are equally apportioned between stages (e.g., 50/50 split for a two-stage system, 1/3 for each stage in a three-stage system, and so forth) assuming that identical SMA actuators are used for each stage.

Platform 230B is disposed on output end 222 of each SMA actuator $\mathbf{221}_i$ in second actuation stage 104-2. Load 108 resides on platform 230B. Platform 230B is movable to enable it and load 108 to be accelerated to launch velocity. Platform 230B couples to rails or guides. Since load 108 is disposed directly on platform 230B, it is advantageously, but not necessarily, a one-way platform.

FIG. 2C depicts an embodiment of cold-launch system 102 that incorporates three actuation stages: first actuation stage 104-1, second actuation stage 104-2, and third actuation stage 104-3. First actuation stage 104-1 includes fixed platform 210 and first plurality of SMA actuators $\mathbf{211}_i$, wherein i=1, n. Second actuation stage 104-2 includes one-way platform 220C and a second plurality of SMA actuators $\mathbf{221}_i$, wherein i=1, p. Third actuation stage 104-3 includes one-way platform 230C and a third plurality of SMA actuators $\mathbf{231}_i$, wherein i=1, q. In some embodiments, a bar-clamp-type arrangement with a sliding jaw and clutch that couple platforms 220C and 230C to vertically-oriented rails or guides to provides the required "one-way" operation.

Second actuation stage 104-2 overlies first actuation stage 104-1 and third actuation stage 104-3 overlies second actuation stage 104-2. In further detail, the platform of an overlying stage abuts the output end of the SMA actuators of each directly underlying stage. Movable platform 240C, which is advantageously, but not necessarily a one-way platform, overlies and abuts output end 232 of SMA actuators $\mathbf{231}_i$.

Like the embodiments that are depicted in FIGS. 2A and 2B, the total number of SMA actuators that are used is dependent upon the weight of the overlying platforms, the weight of load 108, the velocity to which load 108 must be accelerated, and the capacity of the SMA actuators.

Figure 3C:
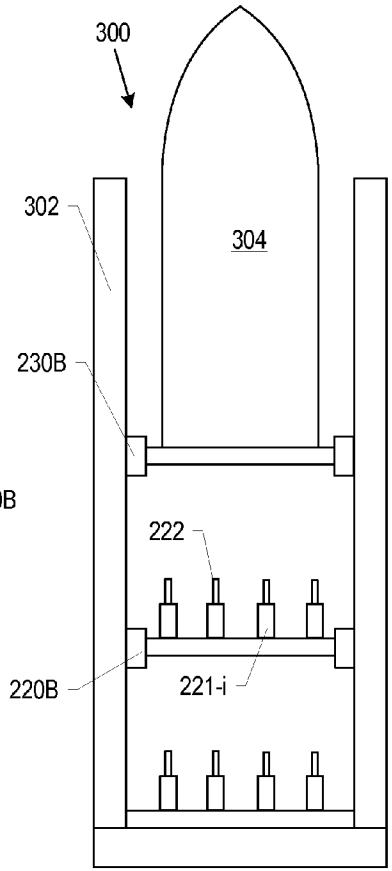
FIGS. 3A through 3C depict the sequential actuation of the various stages of the two stage cold-launch system of FIG. 2B, wherein the cold-launch system is used in conjunction with a missile launcher.
Figure 3B:
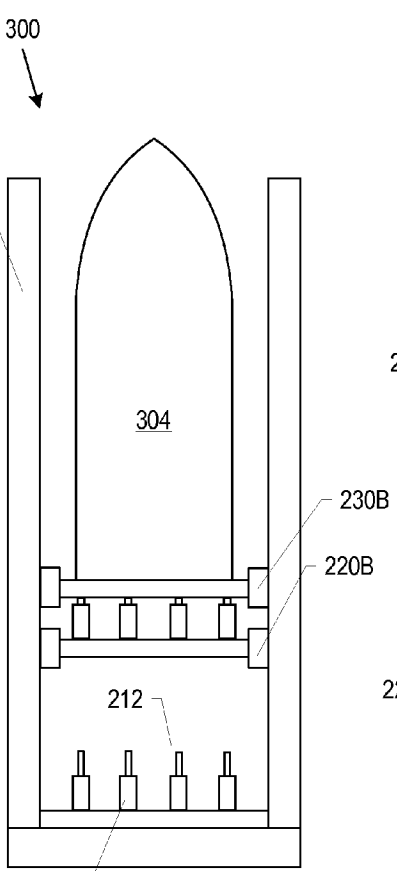
Figure 3A:
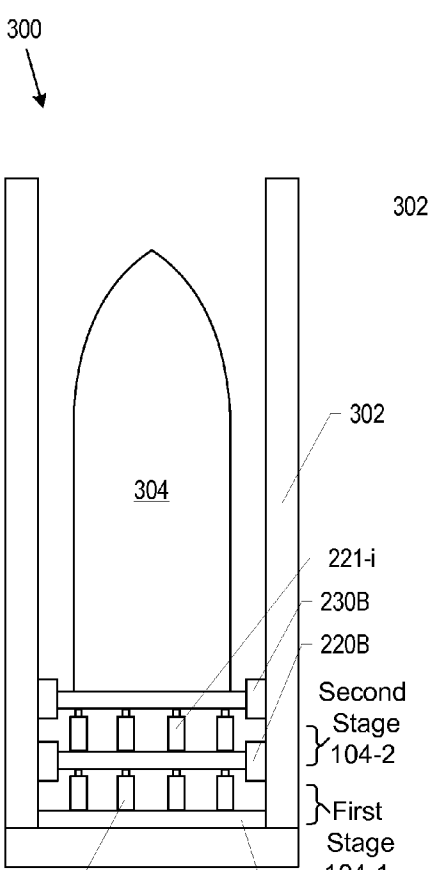

FIGS. 3A through 3C depict the launch of a missile from missile launcher 300, which is a specific embodiment of munitions launcher 100 depicted in FIG. 1. Missile launcher 300 includes a launcher superstructure 302, missile 304, and two-stage cold-launch system 102, such as the depicted in FIG. 2B.

The cold-launch system of missile launcher 300 includes first actuation stage 104-1, second actuation stage 104-2, and movable platform 230B.

First actuation stage 104-1 includes fixed platform 210 and first plurality of SMA actuators $\mathbf{211}_i$, wherein i=1, l. Second actuation stage 104-2 includes one-way platform 220B and a second plurality of SMA actuators $\mathbf{221}_i$, wherein i=l, m. Cold launch system also includes triggering system 106, which is not depicted in FIGS. 3A through 3C for clarity.

FIG. 3A depicts missile launcher 300 before launch. During launch, first actuation stage 104-1 is activated, as depicted in FIG. 3B. Upon activation, rods thrust upward from output end 212 of each of SMA actuators $\mathbf{211}_i$. As previously indicated, the actuators within the first stage are activated simultaneously. The rods exert a force on overlying platform 220B that accelerate the platform and everything above it into motion.

At some time after the first actuation stage is activated, second actuation stage 104-2 is triggered, as depicted in FIG. 3C. As this occurs, platform 220B locks into place against vertical rails or guides (not depicted). Like the SMA actuators in the first stage, rods thrust upward from output end 222 of each SMA actuator $\mathbf{212}_i$. The rods exert a force on overlying platform 230B that further accelerates that platform and missile 304. Since cold-launch system 102 is a two-stage system, missile 304 must be accelerated to launch velocity via second stage 104-2.

Platform 230B and missile 304 progress toward the upper end of launch superstructure 302 where the missile eventually clears the launcher. In some embodiments, there are stops on superstructure 302 that prevent platform 230B from egressing the launcher with missile 304.

Figure 4:
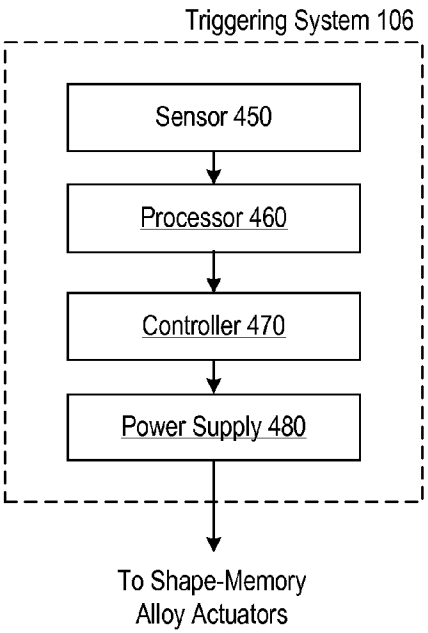
FIG. 4 depicts an embodiment of the triggering system of a cold launch system in accordance with the illustrative embodiment of the present invention.

FIG. 4 depicts the salient elements of an embodiment of triggering system 106. In the illustrative embodiment, the triggering system incorporates sensors 450, processor 460, controller 470, and power (current) supply 480.

The specific make-up of triggering system 106 is dependent upon the particular approach that is used to determine when to activate the SMA actuators in the second and later actuation stages. Also, the particulars of the sensor chosen will dictate the choice of other components in the triggering system (e.g., the need for processor 460, etc.) A few non-limiting approaches for determining when to activate the second stage (or later stages) are listed below:

(1) Load-bound sensors 450 (e.g., accelerometers, etc.) monitor velocity and deliver a signal indicative thereof to processor 460. When a predetermined velocity is reached, processor 460 sends a signal to controller 470 to activate power supply 480. The power supply delivers current to the SMA actuators in the appropriate stage.

(2) Load-bound sensors 450 (e.g., accelerometers, etc.) monitor distance traveled or position and deliver a signal indicative thereof to processor 460. When a predetermined distance has been traveled or a predetermined position is reached, processor 460 sends a signal to controller 470 to activate power supply 480. The power supply delivers current to the SMA actuators in the appropriate stage.

(3) Same as number one above but sensors 450 are disposed on the launcher superstructure rather than on load 108. In such embodiments, sensors 450 are optical, etc., not accelerometers.

(4) Same as number two above but sensors 450 are disposed on the launcher superstructure rather than on load 108. In such embodiments, sensors 450 are optical, etc., not accelerometers.

(5) A relay, switch, etc., that is disposed on the launcher superstructure is triggered by load 108 (or one of the movable platforms) as it passes. The relay/switch activates power supply 480. The power supply delivers current to the SMA actuators in the appropriate stage.

(6) Processor 460 sends a signal to controller 470 to activate power supply 480 at a predetermined elapsed time after activating the previous stage.

In some embodiments, power supply 480 is connected to the SMA sensors in each stage by an electrically-conductive umbilical (not shown). The umbilical is preferably expandable/retractable so that it is relatively unobtrusive and requires minimal space when in a pre-launch state.

Figure 5:
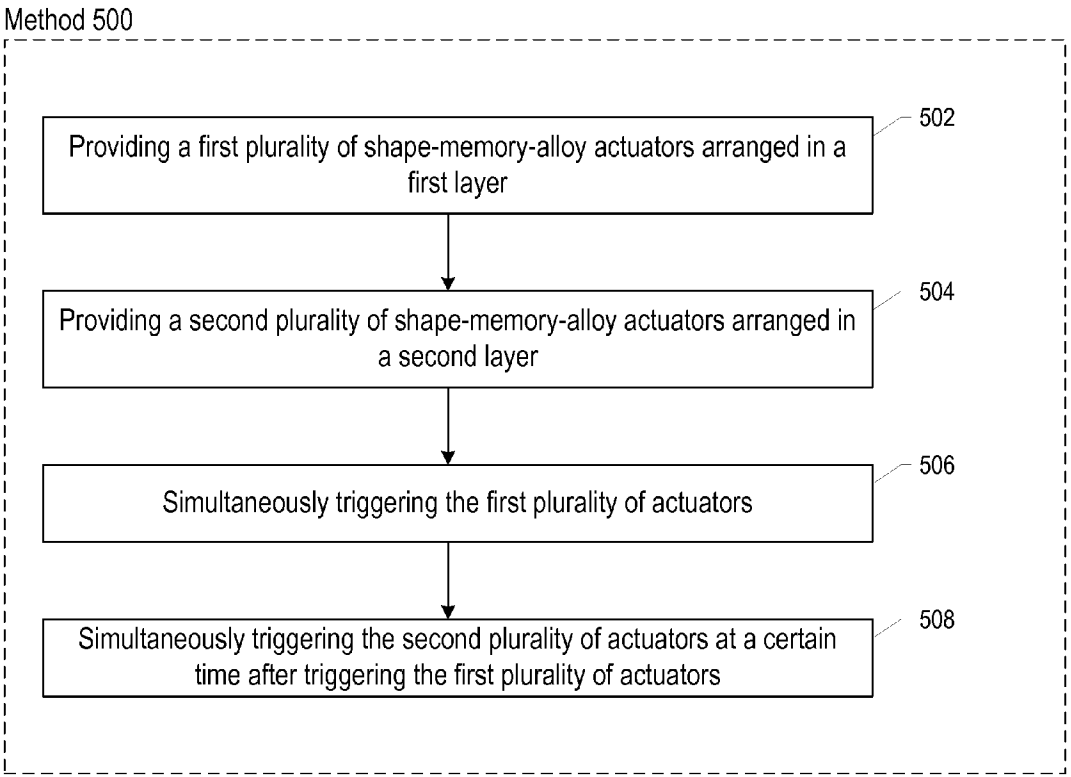
FIG. 5 depicts a method for cold launch.

FIG. 5 depicts method 500 for cold launch. In accordance with operation 502 of method 500, a first plurality of SMA actuators are arranged in a first stage. They are arranged so that the output end of each SMA actuator is co-planar with all other SMA actuators in the first stage. Furthermore, they are electrically coupled to the power supply so that they will simultaneously activate.

In operation 504, a second plurality of SMA actuators are arranged in a second stage. As per operation 502, the SMA actuators are arranged so that the output end of each actuator is co-planar with all other SMA actuators in the second stage. And, like the first stage, the SMA actuators are electrically coupled to the power supply so that they will simultaneously activate.

According to operation 506, the first plurality of SME actuators in the first stage are simultaneously triggered. After triggering the first stage, the second plurality of SMA actuators in the second stage are simultaneously triggered, as per operation 508.

An example that illustrates a method for determining the number of SMA actuators that are required to launch materiel is provided below.

For this example, the materiel being launched is a SM 2 BLK II missile. The missile is to be launched eighty feet above the deck of ship. The following simplifying assumptions are made in conjunction with the calculation:

(1) The neglect of air resistance is neglected.

(2) The effects of the Earth's rotation are neglected.

(3) Acceleration due to gravity is constant (does not change as a function of height).

(4) The origin is set approximately sixteen feet below deck, at the bottom of the missile.

(5) The total distance of travel is 96 feet (16 feet plus 80 feet) or 29.261 meters.

(6). At 96 feet above the origin, the velocity of the missile will be 100 feet/s or 30.48 meters/s.

(7) The weight of the missile is 1500 pounds or 680.85 kilograms.

The launch velocity, $v_i$, is given by the expression:

$$v_i=(g\times t_f)+v_f \quad [1]$$

where:

g is the acceleration due to gravity, 9.8 meters/sec$^2$ $t_f$ is the time, in seconds, required for the missile to travel 96 ft.

$v_f$ is the velocity of the missile, in meters/s, when it travels 96 ft. As given above, $v_f$ is 30.48 meters/s.

The time, $t_f$, is determined as the positive root the expression:

$$y_f=-\tfrac{1}{2}(g\times t_f^2)+(v_i\times t_f)+y_o \quad [2]$$

where:

$y_f$ is the distance traveled, in meters, when the velocity is 100 ft/s. As given above, $y_f$ is 29.261 meters.

$y_o$ is the distance, in meters, that the missile has moved at t=0 (prior to launch), which is, by definition, 0 meters.

Rearranging and substituting, $t_f$=0.845 seconds. Launch velocity, $v_i$, is then determined to be 38.763 meters/s via expression [1].

The force required to accelerate the missile to a given velocity at a given height is given by the expression:

$$F=m(dv/dt) \quad [3]$$

where:

m is the mass, in kilograms, of the missile.

$dv=v_i-v_o$ dt=is the time over which the force is delivered.

From the TINI Aerospace website, the E2000 SMA ejector is capable of delivering 8900 N of force in 120 milliseconds. Therefore, the force required to accelerate the missile, having a mass of 680.85 kg, to a height of 29.26 meters above the deck and traveling at 30.48 meters/s is:

$$F=680.85\text{ kg}(38.763-0)\text{m/s}/(0.12-0)\text{s}=2.199\times10^5\text{ N}$$

The number of E2000 SMA ejectors required is given by the expression:

$$\text{Number Required}=F/8900 \quad [4]$$

Therefore, 24.7 or 25 E2000 SMA ejectors are required for this service.

It is expected that these actuators would be apportioned into two stages, with thirteen SMA actuators in one of the stages and twelve actuators in the other stage.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

We claim:

1. An apparatus comprising a cold launch system, said cold launch system comprising:

a first actuation stage including a first plurality of shape-memory-alloy actuators arranged in a first layer; and a second actuation stage including a second plurality of shape-memory-alloy actuators arranged in a second layer, wherein:

(a) each actuator in both said first stage and said second stage has an output end that operatively couples to a load when said cold launch system is in operation;

(b) said output end of each of said actuators in said first stage are co-planar;

(c) said output end of each of said actuators in said second stage are co-planar;

(d) said first layer and said second stages are sequentially disposed; and (e) said second stage is proximal to said load.

2. The apparatus of claim 1 wherein said cold launch system further comprises a power source, wherein:

(a) said power source is electrically coupled to said actuators in said first stage in such a manner as to apply electrical current simultaneously to said actuators in said first stage; and (b) said power source is electrically coupled to said actuators in said second stage in such a manner as to apply electrical current simultaneously to said actuators in said second stage.

3. The apparatus claim 2 wherein said cold launch system further comprises means for determining when to activate said power source to apply current to said second plurality of actuators in said second stage, wherein current is applied to said second plurality of actuators after current is applied to said first plurality of actuators in said first stage.

4. The apparatus of claim 1 wherein said cold launch system further comprises a movable platform, wherein said movable platform overlies said second actuation stage.

5. The apparatus of claim 4 wherein said second layer of actuators is disposed on a one-way platform, and wherein said one-way platform is movable only in the direction of launch.

6. The apparatus of claim 1 further comprising a triggering system for simultaneously activating said first plurality of actuators at a first time.

7. The apparatus of claim 6 wherein said triggering system comprises:

a processor for determining when to activate said second stage and for generating a first signal;

a controller for receiving said first signal and for generating a second signal in response thereto; and a power source, wherein said power source is electrically coupled to said first stage and said second stage, and wherein said power source receives said second signal, and further wherein said power source delivers electrical current to said second stage in response to receiving said second signal.

8. The apparatus of claim 7 wherein said triggering system further comprises a sensor for determining at least one of a velocity or a position, wherein said velocity or position is indicative of the velocity or the position of said load.

9. The apparatus of claim 6 wherein said triggering system is further operable to simultaneously activate said second plurality of actuators at a second time that is later than said first time.

10. The apparatus of claim 9 wherein said triggering system comprises:

a processor for determining said second time as a function of at least one of:

(a) a position that is indicative of the position of said load;

(b) a velocity that is indicative of the velocity of said load; and (c) a time elapsed since said first time; and a power source for applying electrical current to each of said actuators in said first stage at said first time and to each of said actuators in said second stage at said second time.

11. The apparatus of claim 6 wherein said triggering system comprises:

a switch, wherein said switch is triggered by said load or another object that moves in concert with said load; and a power source, wherein said power source applies electrical current to said second actuation stage in response to said switch being triggered.

12. The apparatus of claim 1 further comprising said load.

13. The apparatus of claim 12 wherein said load is a missile.

14. A method for launch, comprising:

providing a first plurality of shape-memory-alloy actuators arranged in a first stage, wherein said first plurality of actuators are operatively coupled to a load;

providing a second plurality of shape-memory-alloy actuators arranged in a second stage, wherein said second plurality of actuators are operatively coupled to said load, and wherein said first stage and said second stage are sequentially arranged relative to one another, and further wherein said second stage is proximal to said load; and simultaneously triggering said first plurality of actuators at a first time.

15. The method of claim 14 further comprising simultaneously triggering said second plurality of actuators at a second time that is after said first time.

16. The method of claim 15 further comprising tripping a switch to simultaneously trigger said second plurality of actuators.

17. The method of claim 15 wherein simultaneously triggering said first plurality of actuators comprises simultaneously applying an electrical current to said first plurality of actuators and simultaneously triggering said second plurality of actuators comprises simultaneously applying an electrical current to said second plurality of actuators.

18. The method of claim 15 wherein said second plurality of actuators are disposed on a platform, and wherein after said first plurality of actuators are triggered, said load acquires a velocity having a first direction, and wherein the method further comprises:

preventing said platform from moving in a direction that is opposite of said first direction when said second plurality of actuators trigger.

19. The method of claim 14 further comprising monitoring at least one of:

(a) a position that is indicative of the position of said load;

(b) a velocity that is indicative of the velocity of said load; and (c) a time elapsed since said first time.

20. The method of claim 19 further comprising triggering said second plurality of actuators as a function of at least one said monitored position, said monitored velocity, and said time elapsed.

* * * * *